United States Patent [19]

Heap

[11] 3,954,066

[45] May 4, 1976

[54] DRAFT SILL ARRANGEMENT FOR FLAT CAR

[75] Inventor: James C. Heap, Munster, Ind.

[73] Assignee: Thrall Car Manufacturing Company, Chicago Heights, Ill.

[22] Filed: Dec. 12, 1974

[21] Appl. No.: 531,913

[52] U.S. Cl. ..... 105/416; 105/420

[51] Int. Cl.[2] ..... B61D 17/00

[58] Field of Search ..... 105/416, 418, 417, 420; 213/51, 57, 61

[56] References Cited

UNITED STATES PATENTS

| | | | |
|---|---|---|---|
| 2,635,559 | 4/1953 | Nystrom et al. | 105/416 |
| 3,286,659 | 11/1966 | Cunningham | 105/420 |
| 3,774,554 | 11/1973 | O'Neill et al. | 105/416 X |

*Primary Examiner*—John J. Love

*Attorney, Agent, or Firm*—Merriam, Marshall, Shapiro & Klose

[57] ABSTRACT

An underframe arrangement for a railway vehicle and including a deep section center sill joined to a draft sill portion through use of a transition beam member. Both the transition beam member and the draft sill have overlapping flange portions in the area adjacent the car body bolster and center filler. Overlapping these flange portions increases the strength of the draft sill to transition sill connection to resist buff and draft forces by directing these longitudinal forces into the bottom web of the draft sill and transition sill and from there through the transition section and into the deep section center sill which is capable of absorbing and dissipating large longitudinal loads. The overlapping members also increase the strength of the center filler area to provide an improved bolster.

8 Claims, 8 Drawing Figures

DRAFT SILL ARRANGEMENT FOR FLAT CAR

BACKGROUND OF THE INVENTION

1. Field of the Invention:

This invention pertains to railway vehicle underframes and in particular to that portion of the underframe associated with the draft sill and the associated center sill connection in the area of the bolster and center filler.

2. Description of the Prior Art:

Prior art draft sill arrangements have been faced with the problem of minimizing the depth of the draft sill because of space limitations which must be maintained between the top of the truck center plate and the level of a deck. Prior draft sills have sought to compensate for the shallower beam depth of the draft sill by utilization of both elaborate reinforcing ribs abutting the draft gear step lugs and highly reinforced center fillers to thereby efficiently transfer buff and draft forces out of the draft sill and into the center sill beam. By overlapping the draft sill bottom flange with both the bottom cover plate of a transition sill extension and an extension of the center filler bottom cover plate, there is provided an improved draft sill reinforcing structure which evenly transmits longitudinal forces into the flange area of the draft sill beam for dissipation into the transition sill and consequent transmission into the deep beam center sill which has adequate section strength to absorb both extreme buff and extreme draft loading.

SUMMARY

This invention pertains to railway vehicles and in particular to the underframe area of the railway vehicle, especially the draft sill and center filler area. This draft sill arrangement resists buff and draft loads which are extremely high forces imposed directly on this area of the underframe during both coupling and initial movement of a train. Extreme compressive forces are applied to the draft sill during coupling of railway vehicles and extreme tensile loads are placed on the draft sill area during initial movement of a train or pull-out, as it is called. Pull-out resulting in high tensile forces on the draft sill occurs as slack is taken up between a successive number of railway vehicles when a train begins movement from a dead stop.

The draft sill arrangement also includes a wedge-shaped transition beam member which provides a connecting member between a deep beam center sill member and the shallower beam draft sill unit. To adequately dissipate forces which are encountered during buff and draft loading of the draft sill, this invention provides overlapping sections of both the draft sill and the transition beam which combine with side extensions of a center filler bottom plate to provide a rigid force transmission box beam member in the area behind the draft pocket and adjacent the car body bolster. The overlapping members are intended to absorb and resist loading impressed upon the draft sill due to both vertical loads being carried by the car and extreme longitudinal loads which are applied to the car during coupling or startup of a train. Torsional or twisting loads encountered during car movement are also resisted by the tension absorbing box beam structure extending from bolster to bolster. By overlapping the bottom flange and bottom plate portions as well as the bottom plate of the center filler, this invention provides adequate beam strength to the draft sill without the necessity of adding additional strengthening ribs and gussets onto the draft sill, which would require more time and manpower and increase the cost. By overlapping these portions of the draft sill and transition beam, the force transmission and absorption characteristics of the draft sill are improved by providing an adequate force transmitting member for dumping forces from the draft sill into the deeper section transition sill and finally into the center sill which is adequately sized to absorb longitudinal loads.

It is an object of the present invention to provide a railway draft sill arrangement wherein the draft sill includes bottom flange portions which are extended to overlap a bottom cover plate of an adjacent center sill member.

Another object of the present invention is to provide an underframe arrangement including a deep beam center sill section and a shallower beam draft sill interconnected by means of a wedge-shaped transition beam member, and providing the transition beam member with a bottom cover plate having an extension overlapping the associated flange portions of the adjacent draft sill member.

Another object of the present invention is to provide a draft sill having a center filler unit including a plurality of center filler plates extending transversely and longitudinally from a centrally disposed center pin receiving member and being attached to associated center filler front and rear plates as well as to the adjacent webs of the draft sill, and providing the center filler with a bottom plate having transverse outer margins overlapping the adjacent bottom flange of the associated draft sill unit.

These and other objects of the invention will become apparent with reference to the following description, attached drawings, and appended claims.

DESCRIPTION

Figures 1, 2, 4, 8:
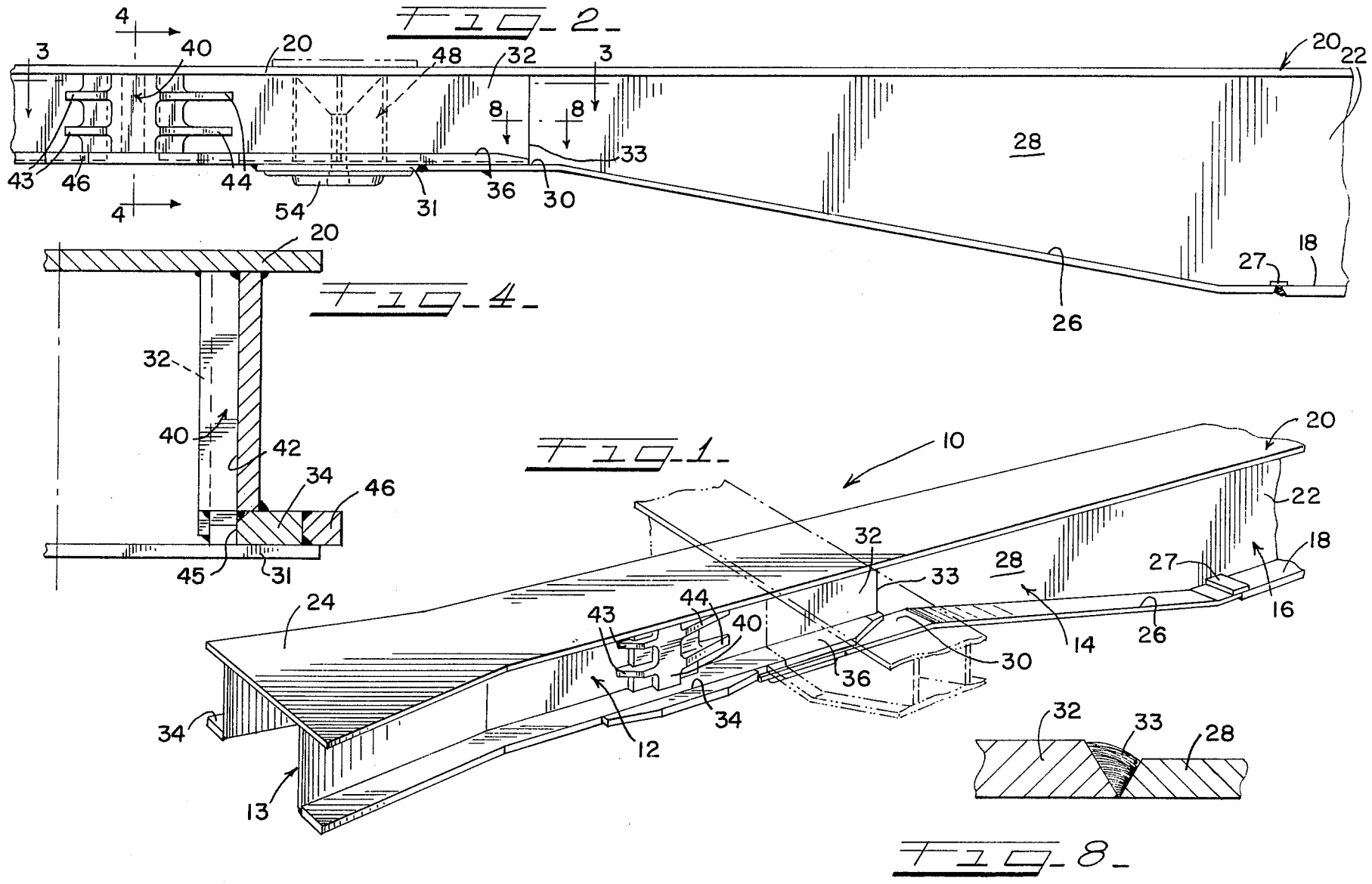
FIG. 1 is a pictorial illustration of the draft sill and associated center sill members involved with the present invention.
FIG. 2 is a side elevational view of the draft sill and associated underframe members illustrated in FIG. 1.
FIG. 4 is a partial and enlarged cross sectional view taken generally along lines 4—4 of FIG. 2.
FIG. 8 is a removed sectional view taken generally along lines 8—8 of FIG. 2.
Figure 3:
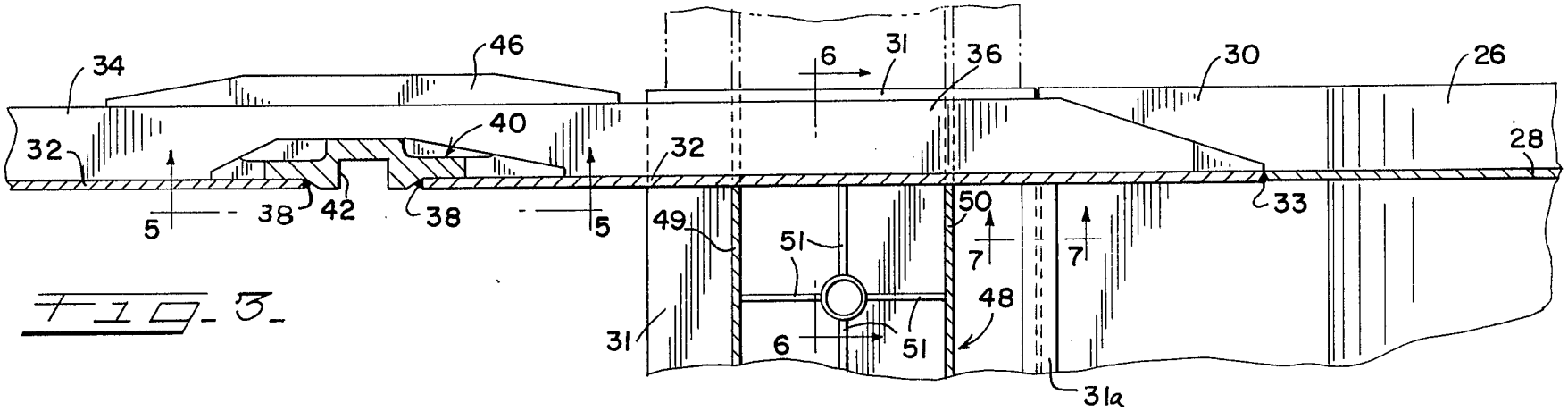
FIG. 3 is a removed cross sectional view taken along lines 3—3 of FIG. 2 with portions deleted for purposes of clarity.

Referring now to the drawings and in particular to FIG. 1, there is illustrated in pictorial the draft sill and associated center sill members involved with the present invention. There is illustrated a continuous longitudinally extending underframe and center sill member designated by the numeral 10, which includes a draft sill unit 12 having a diverging open-end portion or bellmouth opening 13 for accommodating positioning and angular movement of a coupler. Connecting with the draft sill unit 12 is a wedge-shaped transition beam member 14 having a shallow beam portion abutting the associated draft sill 12 and a deeper beam section abutting and fixedly connected to the longitudinally extending center sill beam 16 or the center sill 16 may be a continuation of the wedge-shaped transition beam 14. The center sill beam 16 is a deep section rectangular box beam including a bottom cover plate 18 and a top cover plate 20 which are interconnected by means of the spaced center sill webs 22. The top cover plate 20 is a continuous member which extends along the top of the underframe 10 and includes a diverging portion associated with the bellmouth opening 13 of the draft sill and which is designated by the numeral 24.

The transition beam member 14 forming a connection between draft sill 12 and the center sill 16 may also have a rectangular cross section. The wedge-shaped transition beam member 14 has a sloping bottom cover plate 26 which abuts with the bottom cover plate 18 of the center sill beam unit 16 and is joined thereto by a butt weld. This weld is facilitated by use of a splicer plate 27 welded into position to hold the bottom cover plate 18 adjacent the inclined bottom cover 26 during the welding process. The transition member 14 also includes a pair of transversely spaced side webs 28 which extend between the sloping bottom cover plate 26 and the continuous top cover plate 20, thereby providing the box beam cross section of the transition member 14. The bottom cover plate 26 of the transition member 14 includes an extension 30 which extends beyond the transition member side webs 28 and into an abutting relationship with the bottom cover plate 31 of the center filler assembly. If assembly techniques permit, the extension 30 of bottom cover plate 26 may extend far enough to form the bottom cover of the center filler assembly thus eliminating splice plate 31*a* FIG. 7. Although extension 30 and bottom cover plate 31 of the center filler may be individual, joined members they function structurally as a single member. Once again, a splice plate 31*a* may be tack welded onto the bottom cover extension 30 and onto the center filler bottom plate 31 to facilitate forming the butt weld which joins these two members.

The draft sill 12 which forms a housing for a coupler as well as an associated draft gear or hydraulic cushion units (not shown), includes a pair of spaced side webs 32 which extend vertically between bottom flanges 34 and the top cover plate 20. Draft sill webs 32 abut the transition beam webs 28 at groove weld 33.

Figure 6:
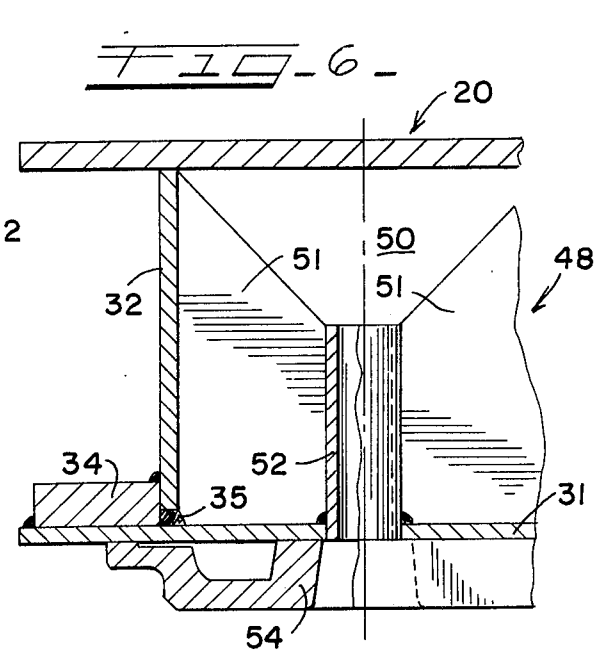
FIG. 6 is a removed and enlarged sectional view taken generally along lines 6—6 of FIG. 3.

As noticed in FIG. 6, the bottom flange 34 of the draft sill unit 12 is attached to each vertical web 32 in a stepped fashion, thereby providing a weld 35 which allows for insertion of a filler weld material to form a secure connection between the bottom flange 34 and each of the associated web portions 32. The bottom flange 34 extends from the bellmouth opening 13 to the transition beam member 14. The draft sill flange 34 also includes an overlapping portion 36 adapted to overlie both the associated bottom cover extension 30 and the side edge margins of the center filler bottom cover plate 31. These overlapping portions are welded together to form a composite unit which is structurally sound and which will transmit longitudinal coupler forces and bolster forces efficiently through the bolster area into the transition member 14 and from there into the center sill 16.

The draft sill unit 12 also includes cutouts 38 in each of the spaced web portions 32 to provide a mounting opening for positioning and attachment of a universal cushion stop unit 40 which is attached to the outside of each draft sill web 32 and then welded into position. The universal cushion stop unit 40 includes a vertically extending slot or cutout 42 facing into the draft sill 12 and in which a connecting lug from a draft gear or hydraulic cushion may be positioned To dissipate and distribute buff and draft forces into the web of the draft sill and from there into the top cover plate 20 and into the bottom flanges 34, the cushion stop unit 40 includes draft ribs 43 and buff and ribs 44. The bottom flanges 34 of the draft sill unit 12 also include cutouts designated by the numeral 45 which permit insertion of a draft gear or hydraulic cushion buffer unit into the universal cushion stop unit 40. To compensate for the loss in section strength due to the cutouts 45, a flange extension plate 46 may be attached to the outside edge of the bottom flange 34 opposite the cutouts 45.

The portion of the draft sill unit 12 which is adjacent car body bolsters (FIG. 1, in phantom) includes a center filler spider unit 48 which includes a transversely extending pair of plates comprising a front plate 49 and a rear plate 50 which interconnect the spaced draft sill webs 32. Center filler spider unit 48 includes a plurality of arm members 51 which extend outwardly from a center pin connecting pipe or tube portion 52, thereby providing transverse resistance to forces transferred to the center filler from the body bolsters. The arms 51, as well as the front plate 49 and the rear plate 50, are welded to the center filler bottom plate 31 which extends outwardly of the draft sill unit 12 and which is part of the overlapping sandwich assembly formed by the draft sill flanges 36 and the bottom cover extension 30. A center plate portion 54 may be welded or mechanically fastened to the underside of the center filler bottom plate 31.

The described structure provided by the invention is directed to improving the structural force dissipation characteristics of a draft sill used in a railway vehicle. By providing a draft sill unit 12 having transversely extending flanges 34 which overlap a bottom cover extension 30 of a transition beam member 14 and join with a center filler bottom plate 31 to form a sandwich of plate members in the bolster area, the present invention efficiently resists bolster crushing forces which are impressed upon the center filler spider unit 48 and also efficiently transmits longitudinal buff forces from the draft sill unit 12 into the center sill beam unit 16. By overlapping portions of the draft sill unit 12 with the side extensions of the center filler bottom cover plate 31 and extensions of the transition beam member 14, an improved draft sill is provided having high resistance to buckling loads which occur during car coupling.

Additionally, vertical forces from the center plate 54 which are directed into the web 32 of the draft sill are also dissipated by the overlapping portions of the draft sill 12 and the transition beam member 14. As noted earlier, the center filler assembly 48 acts to rigidify the bolster arms as well as provide vertical reinforcement to the center plate 54. At the lateral sides of the center plate 54 and in the area of the draft sill side webs 32 the vertical forces transmitted through the center plate 54 can cause cracking or other types of structural damage to the draft sill or bolster assembly during car rocking. When a railway vehicle rocks during movement on uneven track beds, the center plate 54 will oftentimes be tilted from a flush position on the associated mounting bowl of the truck bolster. The compressive forces which are developed during this rocking are enormous, causing deformation and wear on the center plate components due to the extreme area stresses which result. As can be imagined, during rocking it is conceivable that the entire weight of one end of the railway vehicle may be transmitted through a small portion of the center plate 54 and consequently result in these vertical supporting forces being transmitted directly through a smaller portion of the side web 32 of the draft sill and not be evenly distributed through the center filler. The flange parts 36 overlapping the bottom cover extension 30 of the transition beam member 14 forms a reinforced structure to combat premature failure which often occurs in this area of the underframe due to high stress concentration resulting from car rocking. By providing a draft sill weldment which is a composite of attached members, the invention provides for easier attachment of a center plate. As noted in FIG. 6, each bottom flange 34 is attached to the lower side of associated web 32 and in this respect may be attached with reference to the associated flange on the other side of the draft sill to provide a flat horizontal mounting surface for attachment of a center plate. This construction obviates lower flange alignment problems inherent in other draft sills which are formed by joining two z-shaped rolled members. As noted in FIG. 6, the center filler bottom plate 31 is attached to the underside of the bottom flanges 34 and then is used as a mounting surface for the center plate 54. It is important in attaching the center plate 54 to the underframe to provide a flat surface to insure that the center plate 54 is received by a bowl of the truck bolster in completely flush relationship. When the center plate 54 is received flush in the associated truck center plate bowl, vertical support forces are transmitted through a large center plate area thereby reducing surface stress concentration which produces center plate galling and cracking as well as cracking of the draft sill or attached bolsters.

Because flat cars do not contain any above deck reinforcing structures some provision must be made for absorbing twisting forces which occur during car movement as a load rocks back and forth and in turn produces a twisting or warping of the deck. To absorb these twisting forces a torsion resisting structure must be provided. With the underframe provided herein there is a continuous enclosed box beam extending rearward from the bolsters thereby providing an enclosed torsion resisting beam formed by a portion of the draft sills, the transition beams and the center sill beam. This design provides the box beam with overlapping flange and extension sections adjacent each bolster thereby rigidifying the box beam at the point of greatest angular deflection.

Thus, it is noted from the underframe structure provided herein, that because the draft sill undergoes such a variety of loading modes due to longitudinal, bolster, and twisting forces it is oftentimes the part of the railway vehicle which is most susceptible to premature failure. In this invention, the overlapping flanges of the draft sill in combination with the bottom extension 30 of the transition beam 14 provides an enclosed box beam which forms a portion of a rigid connection between the draft sill 12 and the center sill 16. This enclosed, reinforced structure has the unique capabilities of absorbing, dissipating and transmitting the variety of loadings which are applied to the draft sill.

The foregoing detailed description has been given for clearness of understanding only, and no unnecessary limitations should be understood therefrom, as modifications will be obvious to those skilled in the art.

What is claimed is:

1. In a railway vehicle having a reinforced underframe including a continuous center sill extending the length of the vehicle and including end draft sills each being connected to transition beam members which connect a deep section center sill beam, a draft sill to transition beam connection for distribution of longitudinal forces, the improvement comprising:

each draft sill having spaced webs connected to a top cover plate and also including an end section comprising an outwardly opening bellmouthed section and said draft sill also including laterally extending bottom flange portions;

each transition beam member including vertically extending web members attached to a bottom cover plate having side flange portions extending outwardly of said webs, and said transition beam also including a bottom cover extension which extends horizontally beneath and is attached to the draft sill spaced webs;

each transition beam having a generally wedge-spaced contour forming a connection between the deep section center sill beam and the associated shallower beam draft sill;

said draft sill bottom flange portions including overlapping horizontal segments disposed to overlie the bottom cover extension of the transition beam and being attached thereto, thereby forming a reinforced draft sill box beam section for transmitting and absorbing longitudinal forces and vertical bolster loads.

2. The improvement according to claim 1 in which:

each draft sill includes a center filler assembly positioned therein and includes a plurality of mutually perpendicular reinforcing plate members;

said center filler assembly being positioned adjacent laterally extending bolster arm members and attached atop the bottom cover extension of said transition beam member, said bottom cover extension thereby forming a bottom cover plate for the center filler assembly.

3. The improvement according to claim 1 in which:

said draft sill includes a center filler unit positioned between connected bolster arms which extend laterally outwardly from said draft sill; and said overlapping segments of the draft sill bottom flanges and the bottom cover extension being disposed adjacent to said center filler, and thereby strengthening the bolster to draft sill connection.

4. The improvement according to claim 1 in which:

said transition beam has a box-shaped cross section including a horizontally extending top cover plate and said bottom cover plate connects with said vertically extending web members; and said center sill also includes an enclosed cross section having portions joined to the transition beam thereby forming an enclosed continuous structure extending between each of the spaced draft sill units.

5. The improvement according to claim 2 in which:

said center filler includes a bottom cover plate having a laterally extending flange portion extending outwardly of the draft sill unit; and said overlapping segments of the draft sill flanges have portions extending over the laterally extending edges of the center filler bottom plate and include an end portion positioned to overlie and be attached to the bottom cover extension of the transition beam.

6. The improvement according to claim 3 in which:

said draft sill includes vertically extending laterally spaced webs each having a top portion attached to the top cover plate and having a bottom portion; and the laterally extended flanges of the draft sill include a bottom surface vertically spaced below the associated bottom of the adjacent web thereby forming a step segment providing for attachment between the draft sill webs and the laterally extended flange members.

7. In a railway vehicle having a reinforced underframe including a continuous center sill extending the length of the vehicle and including end draft sills each being connected to transition beam members which connect a deep section center sill beam, a draft sill to transition beam connection for distribution of longitudinal forces, the improvement comprising:

each draft sill having spaced webs connected to a top cover plate and also including an end section comprising an outwardly opening bellmouthed section and said draft sill also including laterally extending bottom flange portions;

each transition beam member including vertically extending web members attached to a bottom cover plate having side flange portions extending outwardly of said webs, and said transition beam also including a bottom cover extension;

each transition beam having a generally wedge-shaped contour forming a connection between the deep section center sill beam and the associated shallower beam draft sill;

said draft sill bottom flange portions including overlapping segments disposed to vertically overlie the bottom cover extension of the transition beam and being attached thereto, thereby forming a reinforced draft sill box beam section for transmitting and absorbing longitudinal forces and vertical bolster loads;

said draft sill webs and the associated transition beam web members having abutting and attached end portions;

said overlapping segment of each draft sill bottom flange portion including a tapered end portion adjacent to the attached end portions of the draft sill webs and the transition beam webs;

said overlapping segments of the draft sill flanges including portions extending beyond the draft sill web; and said bottom cover extension of the transition beam extending laterally and interconnecting the flange segments disposed on each side of the draft sill.

8. In a railway vehicle having a reinforced underframe including a continuous center sill extending the length of the vehicle and including end draft sills each being connected to transition beam members which connect a deep section center sill beam, a draft sill to transition beam connection for distribution of longitudinal forces, the improvement comprising:

each draft sill having spaced webs connected to a top cover plate and also including an end section comprising an outwardly opening bellmouthed section and said draft sill also including laterally extending bottom flange portions;

each transition beam member including vertically extending web members attached to a bottom cover plate having side flange portions extending outwardly of said webs, and said transition beam also including a bottom cover extension;

each transition beam having a generally wedge-shaped contour forming a connection between the deep section center sill beam and the associated shallower beam draft sill;

said draft sill bottom flange portions including overlapping segments disposed to vertically overlie the bottom cover extension of the transition beam and being attached thereto, thereby forming a reinforced draft sill box beam section for transmitting and absorbing longitudinal forces and vertical bolster loads;

said draft sill webs and the associated transition beam web members having abutting and attached end portions; and said overlapping segment of each draft sill bottom flange portion including a tapered end portion adjacent to the attached end portions of the draft sill webs and the transition beam webs.

* * * * *

UNITED STATES PATENT AND TRADEMARK OFFICE

CERTIFICATE OF CORRECTION

PATENT NO. : 3,954,066

DATED : May 4, 1976

INVENTOR(S) : James C. Heap

Figure 7:
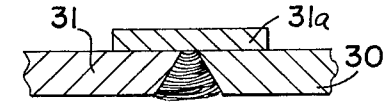
FIG. 7 is a removed and enlarged cross sectional view taken along lines 7—7 of FIG. 3.
Figure 5:
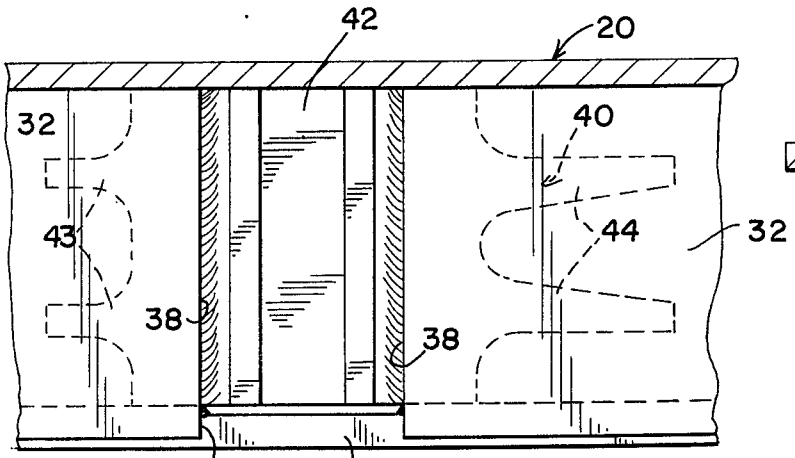
FIG. 5 is an enlarged view taken generally along lines 5—5 of FIG. 3.

It is certified that error appears in the above-identified patent and that said Letters Patent are hereby corrected as shown below:

Column 3, line 37, change "Fig. 7." to --(Fig. 7).--; column 4, line 11, change "buff and" to --buff--; column 5, line 16, start a paragraph with "By", and in line 33, change "a bowl" to --the bowl--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*